US007999750B2

(12) United States Patent
Mansour et al.

(10) Patent No.: US 7,999,750 B2
(45) Date of Patent: Aug. 16, 2011

(54) LOW PROFILE ANTENNA FOR SATELLITE COMMUNICATION

(75) Inventors: David Mansour, Haifa (IL); Valentina Berdnikova, Yoqneam (IL); Simha Erlich, Raanana (IL)

(73) Assignee: Starling Advanced Communications Ltd., Yoqneam (IL)

( * ) Notice: Subject to any disclaimer, the term of this patent is extended or adjusted under 35 U.S.C. 154(b) by 0 days.

(21) Appl. No.: 12/461,239

(22) Filed: Aug. 5, 2009

(65) Prior Publication Data

US 2009/0295656 A1 Dec. 3, 2009

Related U.S. Application Data

(60) Continuation of application No. 11/477,600, filed on Jun. 30, 2006, now Pat. No. 7,768,469, which is a division of application No. 10/546,264, filed as application No. PCT/IL2004/000149 on Feb. 18, 2004, now Pat. No. 7,629,935.

(30) Foreign Application Priority Data

Feb. 18, 2003 (IL) ..... 154525

(51) Int. Cl.
*H01Q 3/00* (2006.01)

(52) U.S. Cl. ..... 343/757; 343/766; 343/882

(58) Field of Classification Search ..... 343/757, 343/758, 763, 766, 882
See application file for complete search history.

(56) References Cited

U.S. PATENT DOCUMENTS 3,810,185 A 5/1974 Wilkinson
4,263,598 A 4/1981 Bellee et al.
4,486,758 A 12/1984 de Ronde
4,527,165 A 7/1985 de Ronde
4,614,947 A 9/1986 Rammos
4,647,938 A 3/1987 Roederer et al.
4,679,051 A 7/1987 Yabu et al.
4,801,943 A 1/1989 Yabu et al.
5,089,824 A 2/1992 Uematsu et al.
5,245,348 A * 9/1993 Nishikawa et al. ..... 342/359
5,258,250 A 11/1993 Shirai et al.
5,309,162 A 5/1994 Uematsu et al.
5,398,035 A 3/1995 Densmore et al.
5,404,509 A 4/1995 Klein (Continued)

FOREIGN PATENT DOCUMENTS

EP 0089084 9/1983

(Continued)

OTHER PUBLICATIONS

Communication Pursuant to Article 94(3) EPC dated Oct. 28, 2008, from the European patent Office Re: Application No. 04712141.3.

(Continued)

*Primary Examiner* — Tan Ho
(74) *Attorney, Agent, or Firm* — Pearl Cohen Zedek Latzer, LLP

(57) ABSTRACT

A low profile receiving and/or transmitting antenna includes an array of antenna elements that collect and coherently combine millimeter wave or other radiation. The antenna elements are physically configured so that radiation at a predetermined wavelength band impinging on the antenna at a particular angle of incidence is collected by the elements and collected in-phase. Two or more mechanical rotators may be disposed to alter the angle of incidence of incoming or outgoing radiation to match the particular angle of incidence.

37 Claims, 4 Drawing Sheets

U.S. PATENT DOCUMENTS

| | | | |
|---|---|---|---|
| 5,420,598 | A | 5/1995 | Uematsu et al. |
| 5,508,731 | A | 4/1996 | Kohorn |
| 5,512,906 | A | 4/1996 | Speciale |
| 5,528,250 | A | 6/1996 | Sherwood et al. |
| 5,537,141 | A | 7/1996 | Happer et al. |
| 5,544,299 | A | 8/1996 | Wenstrand et al. |
| 5,579,019 | A | 11/1996 | Uematsu et al. |
| 5,596,336 | A | 1/1997 | Liu |
| 5,678,171 | A | 10/1997 | Toyama et al. |
| 5,712,644 | A | 1/1998 | Kolak |
| 5,740,035 | A | 4/1998 | Cohen et al. |
| 5,751,247 | A | 5/1998 | Nomoto et al. |
| 5,764,199 | A | 6/1998 | Ricardi |
| 5,767,897 | A | 6/1998 | Howell |
| 5,781,163 | A | 7/1998 | Ricardi et al. |
| 5,799,151 | A | 8/1998 | Hoffer |
| 5,801,754 | A | 9/1998 | Ruybal et al. |
| 5,823,788 | A | 10/1998 | Lemelson et al. |
| 5,841,980 | A | 11/1998 | Waters et al. |
| 5,861,881 | A | 1/1999 | Freeman et al. |
| 5,872,545 | A | 2/1999 | Rammos |
| 5,878,214 | A | 3/1999 | Gilliam et al. |
| 5,880,731 | A | 3/1999 | Liles et al. |
| 5,886,671 | A | 3/1999 | Riemer et al. |
| 5,916,302 | A | 6/1999 | Dunn et al. |
| 5,917,310 | A | 6/1999 | Baylis |
| 5,929,819 | A | 7/1999 | Grinberg |
| 5,961,092 | A | 10/1999 | Coffield |
| 5,978,835 | A | 11/1999 | Ludwig et al. |
| 5,982,333 | A | 11/1999 | Stillinger et al. |
| 5,983,071 | A | 11/1999 | Gagnon et al. |
| 5,991,595 | A | 11/1999 | Romano et al. |
| 5,995,951 | A | 11/1999 | Ferguson |
| 5,999,208 | A | 12/1999 | Mcnerney et al. |
| 6,049,306 | A | 4/2000 | Amarillas |
| 6,061,082 | A | 5/2000 | Park |
| 6,061,440 | A | 5/2000 | Delaney et al. |
| 6,061,716 | A | 5/2000 | Moncreiff |
| 6,064,978 | A | 5/2000 | Gardner et al. |
| 6,074,216 | A | 6/2000 | Cueto |
| 6,078,948 | A | 6/2000 | Podgorney et al. |
| 6,120,534 | A | 9/2000 | Ruiz |
| 6,124,832 | A | 9/2000 | Jeon et al. |
| 6,160,520 | A | 12/2000 | Muhlhauser et al. |
| 6,169,522 | B1 | 1/2001 | Ma et al. |
| 6,184,828 | B1 | 2/2001 | Shoki |
| 6,191,734 | B1 | 2/2001 | Park et al. |
| 6,195,060 | B1 | 2/2001 | Spano et al. |
| 6,204,823 | B1 | 3/2001 | Spano et al. |
| 6,218,999 | B1 | 4/2001 | Bousquet et al. |
| 6,249,809 | B1 | 6/2001 | Bro |
| 6,256,663 | B1 | 7/2001 | Davis |
| 6,259,415 | B1 | 7/2001 | Kumpfbeck et al. |
| 6,297,774 | B1 | 10/2001 | Chung |
| 6,304,861 | B1 | 10/2001 | Ferguson |
| 6,331,837 | B1 | 12/2001 | Shattil |
| 6,347,333 | B2 | 2/2002 | Eisendrath et al. |
| 6,407,714 | B1 | 6/2002 | Butler et al. |
| 6,442,590 | B1 | 8/2002 | Inala et al. |
| 6,483,472 | B2 | 11/2002 | Cipolla et al. |
| 6,486,845 | B2 | 11/2002 | Ogawa et al. |
| 6,496,158 | B1 | 12/2002 | Ksienski et al. |
| 6,578,025 | B1 | 6/2003 | Pollack et al. |
| 6,624,787 | B2 | 9/2003 | Puzella et al. |
| 6,657,589 | B2 | 12/2003 | Wang et al. |
| 6,661,388 | B2 | 12/2003 | Desargant et al. |
| 6,677,908 | B2 | 1/2004 | Strickland |
| 6,707,432 | B2 | 3/2004 | Strickland |
| 6,738,024 | B2 | 5/2004 | Butler et al. |
| 6,765,542 | B2 | 7/2004 | McCarthy et al. |
| 6,771,225 | B2 | 8/2004 | Tits |
| 6,778,144 | B2 | 8/2004 | Anderson |
| 6,792,448 | B1 | 9/2004 | Smith |
| 6,822,612 | B2 | 11/2004 | Takimoto et al. |
| 6,839,039 | B2 | 1/2005 | Tanaka et al. |
| 6,861,997 | B2 | 3/2005 | Mahon |
| 6,864,837 | B2 | 3/2005 | Runyon et al. |
| 6,864,846 | B2 | 3/2005 | King |
| 6,873,301 | B1 | 3/2005 | Lopez |
| 6,897,806 | B2 | 5/2005 | Toshev |
| 6,950,061 | B2 | 9/2005 | Howell et al. |
| 6,999,036 | B2 | 2/2006 | Stoyanov et al. |
| 7,061,432 | B1 | 6/2006 | Tavassoli Hozouri |
| 7,253,777 | B2 | 8/2007 | Blaschke et al. |
| 7,382,329 | B2 | 6/2008 | Kim |
| 7,385,562 | B2 | 6/2008 | Stoyanov et al. |
| 7,492,322 | B2 | 2/2009 | Jung et al. |
| 7,595,762 | B2 | 9/2009 | Mansour |
| 7,629,935 | B2 | 12/2009 | Mansour et al. |
| 7,768,469 | B2 * | 8/2010 | Mansour et al. ..... 343/757 |
| 2001/0026245 | A1 | 10/2001 | Cipolla et al. |
| 2002/0072955 | A1 | 6/2002 | Brock |
| 2002/0128898 | A1 | 9/2002 | Smith et al. |
| 2002/0194054 | A1 | 12/2002 | Erengut |
| 2003/0067410 | A1 | 4/2003 | Puzella et al. |
| 2003/0088458 | A1 | 5/2003 | Afeyan et al. |
| 2003/0122724 | A1 | 7/2003 | Shelley et al. |
| 2004/0178476 | A1 | 9/2004 | Boyanov et al. |
| 2004/0233122 | A1 | 11/2004 | Espenscheid et al. |
| 2005/0057396 | A1 | 3/2005 | Boyanov |
| 2005/0146473 | A1 | 7/2005 | Stoyanov et al. |
| 2005/0259021 | A1 | 11/2005 | Stoyanov et al. |
| 2005/0259201 | A1 | 11/2005 | Hu et al. |
| 2006/0132372 | A1 | 6/2006 | Jung et al. |
| 2006/0197713 | A1 | 9/2006 | Mansour et al. |
| 2006/0244669 | A1 | 11/2006 | Mansour et al. |
| 2007/0085744 | A1 | 4/2007 | Engel |
| 2007/0146222 | A1 | 6/2007 | Mansour |

FOREIGN PATENT DOCUMENTS

| | | |
|---|---|---|
| EP | 123350 | 10/1984 |
| EP | 0481417 | 4/1992 |
| EP | 0518271 | 12/1992 |
| EP | 0520424 | 12/1992 |
| EP | 0 546 513 | 6/1993 |
| EP | 0 557 853 | 9/1993 |
| EP | 1 604 427 | 12/2005 |
| JP | 62-173807 | 7/1987 |
| JP | 63-108805 | 5/1988 |
| JP | 63-174411 | 7/1988 |
| JP | 2-137402 | 5/1990 |
| JP | 03-247003 | 11/1991 |
| JP | 6-69712 | 3/1994 |
| JP | 06-237113 | 8/1994 |
| JP | 8-321715 | 12/1996 |
| JP | 63/171003 | 7/1998 |
| WO | 89/09501 | 10/1989 |
| WO | 00/75829 | 12/2000 |
| WO | WO 01/11718 | 2/2001 |
| WO | 01/84266 | 11/2001 |
| WO | 02/19232 | 3/2002 |
| WO | 02/057986 | 7/2002 |
| WO | 02/103842 | 12/2002 |
| WO | WO 02/097919 | 12/2002 |
| WO | 03/052868 | 6/2003 |
| WO | 03/096576 | 11/2003 |
| WO | 2004/042492 | 5/2004 |
| WO | 2004/079859 | 9/2004 |
| WO | 2004/079861 | 9/2004 |
| WO | WO 2004/075339 | 9/2004 |
| WO | WO 2004/079861 | 9/2004 |
| WO | 2004/097972 | 11/2004 |
| WO | 2005/004284 | 1/2005 |
| WO | WO 2005/067098 | 7/2005 |
| WO | 2007/046055 | 4/2007 |
| WO | 2007/063434 | 6/2007 |

OTHER PUBLICATIONS

Communication Pursuant to Article 96(2) EPC Dated Oct. 4, 2006 From the European Patent Office Re.: Application No. 04712141.3.

Supplementary European Search Report Dated Dec. 23, 2005 From the European Patent Office Re.: Application No. 04712141.3.

Response dated Ferbruary 10, 2009, to the Communication Pursuant to Article 94(3) EPC dated Aug. 25, 2008 from the EPO re EP 06809614.8.

Communication Pursuant to Article 94(3) EPC dated Jul. 22, 2009 from the EPO re EP 06809614.8.
International Preliminary Report on Patentability Dated May 27, 2005 From the International Preliminary Examining Authority Re.: Application No. PCT/IL04/00149.
International Search Report Dated Oct. 14, 2004 From the International Searching Authority Re.: Application No. PCT/IL04/00149.
Written Opinion Dated Oct. 14, 2004 From the International Searching Authority Re.: Application No. PCT/IL04/00149.
International Search Report for PCT/IL2005/000020 dated Apr. 20, 2005.
Response Dated Dec. 27, 2009 to Communication Pursuant to Article 94(3) EPC of Sep. 4, 2009 From the European Patent Office Re.: Application No. 06809615.5.
Supplementary European Search Report and the European Search Opinion Dated Jul. 6, 2009 from the European Patent Office Re.: Application No. 06809615.5.
International Preliminary Report on Patentability dated Mar. 14, 2008, from the IPEA re PCT/IB2006/053805.
International Search Report dated Jul. 30, 2008, re PCT/IB06/53806.
International Searching Authority Written Opinion dated Jul. 30, 2008, re PCT/IB06/53806.
Response dated Mar. 3, 2008, to International Search Report and Written Opinion dated Oct. 9, 2007, re PCT/IB306/53806.
Response dated Jul. 14, 2008, to the Communication Pursuant to Rules 161 and 162 EPC dated May 26, 2008, from the EPO re EP 06809614.8.
Response dated Sep. 22, 2008, to the Communication Pursuant to Article 94(3) EPC dated Aug. 25, 2008, from the EPO re EP 06809614.8.
Notice of Allowance Dated Aug. 4, 2009 in U.S. Appl. No. 10/546,264.
Office Action dated Dec. 24, 2008 in U.S. Appl. No. 10/546,264 and response thereto dated Mar. 24, 2009.
Office Action dated Jul. 14, 2008 in U.S. Appl. No. 11/580,306 and response thereto dated Dec. 15, 2008.
Notice of Allowance dated Apr. 2, 2010 From the US Patent and Trademark Office Re.: U.S. Appl. No. 11/477,600.
Official Action Dated Nov. 30, 2009 From the US Patent and Trademark Office Re.: U.S. Appl. No. 11/477,600.
Office Action dated Feb. 5, 2009 in U.S. Appl. No. 11/477,600.
Office Action dated Feb. 24, 2009, and Response thereto dated Mar. 23, 2009 in U.S. Appl. No. 11/440,054.
English translation of Notification of Reasons of Rejection dated Jan. 21, 2009 from the Japanese Patent Office re Application No. 2006-502642.
Office Action Dated May 3, 2009 From the Israeli Patent Office Re.: Application No. 171450 and its Translation into English.
Israeli Office Action dated Feb. 25, 2007, re Israeli Application No. 154525, and English translation thereof.
Israeli Office Action dated Nov. 23, 2008, re Israeli Application No. 154525, and English translation thereof.
LeVine, et al., "Component Design Trends—Dual-Mode Horn Feed for Microwave Multiplexing," Electronics, vol. 27, pp. 162-164 (Sep. 1954).
Stuchly, et al., "Wide-Band Rectangular to Circular Waveguide Mode and Impedance Transformer," IEEE Transactions on Microwave Theory and Techniques, vol. 13, pp. 379-380 (May 3, 1965).
Felstead, E. Barry, "Combining Multiple Sub-Apertures for Reduced-Profile Shipboard Satcom-Antenna Panels", IEEE. Milcom 2001. Proceedings. Communications for Network-Centric Operations: Creating the Information Force. Oct. 28-30, 2001, XP010579091, pp. 665-669.
Ito, Yasuhiro et al., "A Mobile 12 GHz DBS Television Receiving System", IEEE Transactions on Broadcasting, vol. 35, No. 1, Mar. 1, 1989, pp. 56-61.
Peeler, G. D. M. et al., "Virtual Source Luneberg Lenses", I-R-E Transactions—Antennas and Propagation, 1953, pp. 94-99.
Peeler, G. D. M. et al., "Microwave Stepped-Index Luneberg Lenses", IRE Transactions on Antennas and Propagation, 1957, pp. 202-207.
Peeler, G. D. M. et al., "A Two-Dimensional Microwave Luneberg Lens", I.R.E. Transactions—Antennas and Propagation, 1953, pp. 12-23.
MR-Live "MR-Live-Take the Pulse of Your Market," Product Overview, 11 P., 2001.
Communication Pursuant to Article 94(3) EPC Dated Mar. 1, 2010 From the European Patent Office Re.: Application No. 06809615.5.
Communication Pursuant to Article 94(3) EPC Dated Sep. 4, 2009 From the European Patent Office Re.: Application No. 06809615.5.
Communication Pursuant to Article 94(3) EPC Dated Feb. 16, 2010 From the European Patent Office Re.: Application No. 06809614.8.
Communication Pursuant to Article 94(3) EPC Dated Jul. 22, 2009 From the European Patent Office Re.: Application No. 06809614.8.
Communication Pursuant to Article 94(3) EPC Dated Aug. 25, 2008 From the European Patent Office Re.: Application No. 06809614.8.
International Preliminary Report on Patentability Dated Jan. 22, 2009 From the International Bureau of WIPO Re.: Application No. PCT/IB2006/053806.
International Search Report Dated Oct. 9, 2007 From the International Searching Authority Re.: Application No. PCT/IB2006/053805.
Office Action Dated Mar. 19, 2008 From the Israeli Patent Office Re.: Application No. 154525.
Response Dated Apr. 8, 2010 to Official Action of Nov. 30, 2009 From the US Patent and Trademark Office Re.: U.S. Appl. No. 11/477,600.
Translation of Notification of Reasons of Rejection Dated Mar. 26, 2010 From the Japanese Patent Office Re.: Application No. 2006-502642.
Written Opinion Dated Oct. 9, 2007 From the International Searching Authority Re.: Application No. PCT/IB2006/053805.
Written Opinion Dated Jul. 30, 2008 From the International Searching Authority Re.: Application No. PCT/IB06/53806.
Response Dated May 31, 2010 to Communication Pursuant to Article 94(3) EPC of Feb. 16, 2010 From the European Patent Office Re.: Application No. 06809614.8.
Office Action Dated May 2, 2010 From the Israeli Patent Office Re.: Application No. 171450 and its Translation into English.
Office Action Dated May 20, 2010 From the Israeli Patent Office Re.: Application No. 154525 and its Translation Into English.
Response Dated Jun. 20, 2010 to Notification of Reasons of Rejection of Mar. 26, 2010 From the Japanese Patent Office Re.: Application No. 2006-502642.
Response Dated Jun. 28, 2010 to Communication Pursuant to Article 94(3) EPC of Mar. 1, 2010 From the European Patent Office Re.: Application No. 06809615.5.
NetOnCourse, "Harnessing the Value of Mass E-Gathering," www.netoncourse.com, 12 P., 2000.
NetOnCourse, "NetOnCourse. Masters of Future Think," 4P, 1999.
Declaration of Messrs. Micha Lawrence and David Levy (Jan. 10, 2006) including Exhibits re Sep. 9-12, 2003 Public Display in Seattle, Washington, USA.

* cited by examiner

LOW PROFILE ANTENNA FOR SATELLITE COMMUNICATION

CROSS-REFERENCE TO RELATED APPLICATIONS

This is a continuation of application Ser. No. 11/477,600 filed on Jun. 30, 2006, now U.S. Pat No. 7,629,469 which is a continuation of application Ser. No. 10/546,264 filed on Mar. 3, 2006 (now U.S. Patent No. 7,629,935), which is the U.S. National Phase of International Application No. PCT/IL2004/000149 filed on Feb. 18, 2004, which designated the United States and which claims priority based on Israeli Application No. 154525 filed Feb. 18, 2003, the entire contents of all of which are hereby incorporated by reference.

TECHNICAL FIELD

The present invention relates generally to antennae and, more particularly, to low profile receiving/transmitting antennae, that may be used in satellite communication systems and intended to be installed at mobile terminals in order to achieve global coverage and/or used at terrestrial wireless communication platforms with constraints on the physical dimensions of the antennae.

BACKGROUND

Satellites are commonly used to relay or communicate electronic signals, including audio, video, data, audio-visual, etc. signals, to or from any portion of a large geographical area. In some cases, satellites are used to relay or communicate electronic signals between a terrestrial center and airborne terminals that are usually located inside aircraft. As an example, a satellite-based airborne or mobile signal distribution system generally includes an earth station that compiles one or more individual audio/visual/data signals into a narrowband or broadband signal, modulates a carrier frequency (wavelength) band with the compiled signal and then transmits (uplinks) the modulated RF signal to one or more, for example, geosynchronous satellites. The satellites amplify the received signal, shift the signal to a different carrier frequency (wavelength) band and transmit (downlink) the frequency shifted signal to aircraft for reception at individual receiving units or mobile terrestrial terminals.

Likewise, individual airborne or mobile terminals may transmit an RF signal, via a satellite, to the base station or to other receiving units.

SUMMARY

The present exemplary embodiments relate to a low profile receiving and/or transmitting antenna. The low profile antenna 10 (FIGS. 1-2) may comprise an array of antenna elements 12 that are interconnected by suitable combining/splitting transmission lines, etc. 8 to coherently combine millimeter wave or other radiation at a single electrical summation point 9. The antenna elements 12 and the electrical combining/splitting transmission line interconnections 8 may be physically configured so that radiation at a predetermined wavelength band impinging on the antenna at a particular angle of incidence is collected coherently (i.e., by providing suitable signal phasing/delay in order to maintain the desired array radiation pattern parameters). This construction allows summing (i.e., combining when receiving; splitting when transmitting) networks 8 to sum the signals collected by the antenna elements such as to produce a sufficiently high antenna gain, which allows the antenna to be used with relatively low power satellite or wireless terrestrial networks.

According to one aspect of the present exemplary embodiments, an antenna 10 comprises a plurality of antenna elements 12 that may be disposed within a collection of active panels 14. Each of the elements 12 as mounted on active panels 14, may be disposed at a particular angle of incidence ax with respect to a reference plane 11 so that each of the elements collects radiation impinging on it at a particular angle of incidence and directs it onto an associated summation circuit 8 to a panel element port 8*a* which panel ports are, in turn, similarly interconnected to a common RF input/output port 9. The antenna elements 12 may be disposed in sub arrays associated respectively with panels 14; each may contain rows and columns so that the elements within each sub-array are in a common plane, hereinafter an active panel 14. Elements 12 in an adjacent sub-array 14 may be displaced on an adjacent active panel 14, i.e., that is spatially offset (e.g., displaced) with respect to the other sub-array(s) 14.

Each sub-array may comprise antenna elements 12 that are disposed on an active panel 14 and arranged in rows and columns, or any other suitable arrangement.

Preferably, adjacent sub-arrays are separated by an active panel-to-active panel offset distance D that varies with the angle of incidence a in such a way that when all active panels point at this angle of incidence, then no active panel is hidden or covered by any other active panel and the active panels of the composite antenna array appear to be continuous (i.e., contiguous with respect to each other) at the required angle of incidence.

The antenna may include one or more steering devices to steer the beam associated with the antenna. In particular, mechanical or motorized devices 21, 22, 23 may collectively rotate the active panels in the azimuth direction to steer the antenna beam in the azimuth direction and/or may tilt the individual active panels to steer the antenna beam in the elevation direction (and suitably displace at least one panel in a transverse direction so as to avoid substantial gaps or overlaps between their projections) for both reception and transmission.

According to another aspect of the present exemplary embodiments, a reception/transmission antenna array comprises an antenna receiver/transmitter array having an antenna beam pointed in a beam direction and mechanical devices associated with the antenna receiver/transmitter array for altering the beam pointing direction associated with the antenna during both signal reception and signal transmission. Preferably, the mechanical devices change the beam pointing direction over a range of beam directions.

DESCRIPTION OF EXEMPLARY EMBODIMENTS

A low profile receiving/transmitting antenna built and operating according to some embodiments of the present invention is described herein below. The low profile receiving/transmitting antenna is described as being constructed for use with a Millimeter Wave (MMW) geosynchronous satellite communication system. It would be apparent, however, to a person with ordinary skill in the art that many kinds of antennae could be constructed according to the principles disclosed herein below, for use with other desired satellite or ground-based, audio, video, data, audio-visual, etc. signal distribution systems including, but not limited to, so-called "C-band" systems (which transmit at carrier frequencies between 3.7 GHz and 4.2 GHz), land-based wireless distribution systems such as multi-channel, multi-point distribution systems (MMDS) and local multi-point distribution systems (LMDS), cellular phone systems, and other wireless communication systems that need a low profile antenna due to physical constraints.

In fact, an antenna of the present invention may be constructed according to the principles disclosed herein for use with communication systems which operate also at wavelengths shorter than the MMW range, such as sub-millimeter wave and terra-wave communication systems, or at wavelengths longer than the MMW range, such as microwave communication systems.

Figure 1:
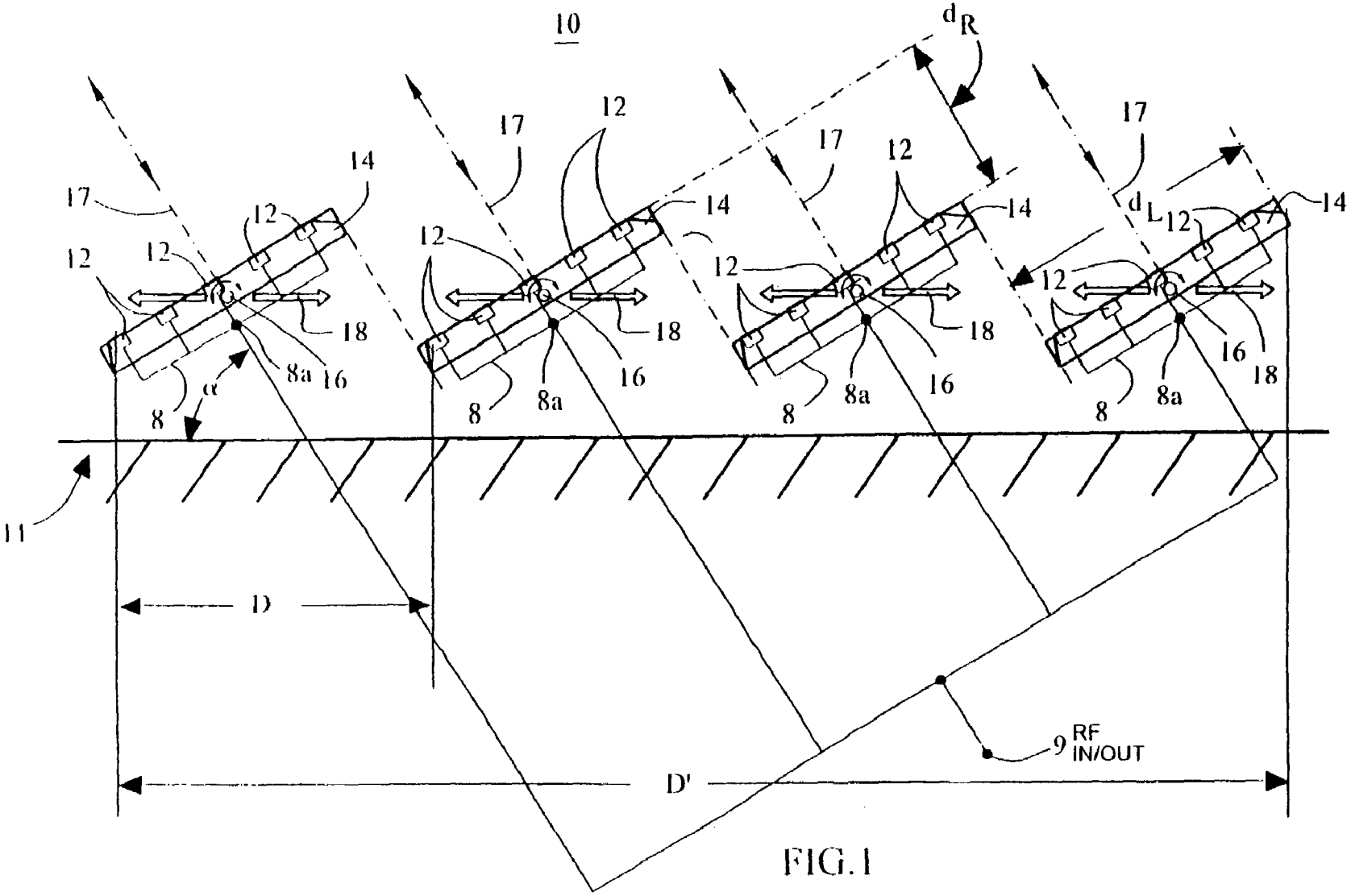
FIG. 1 is a two-dimensional, diagrammatic view of an embodiment of an antenna array system according to some embodiments of the present invention.
Figure 2:
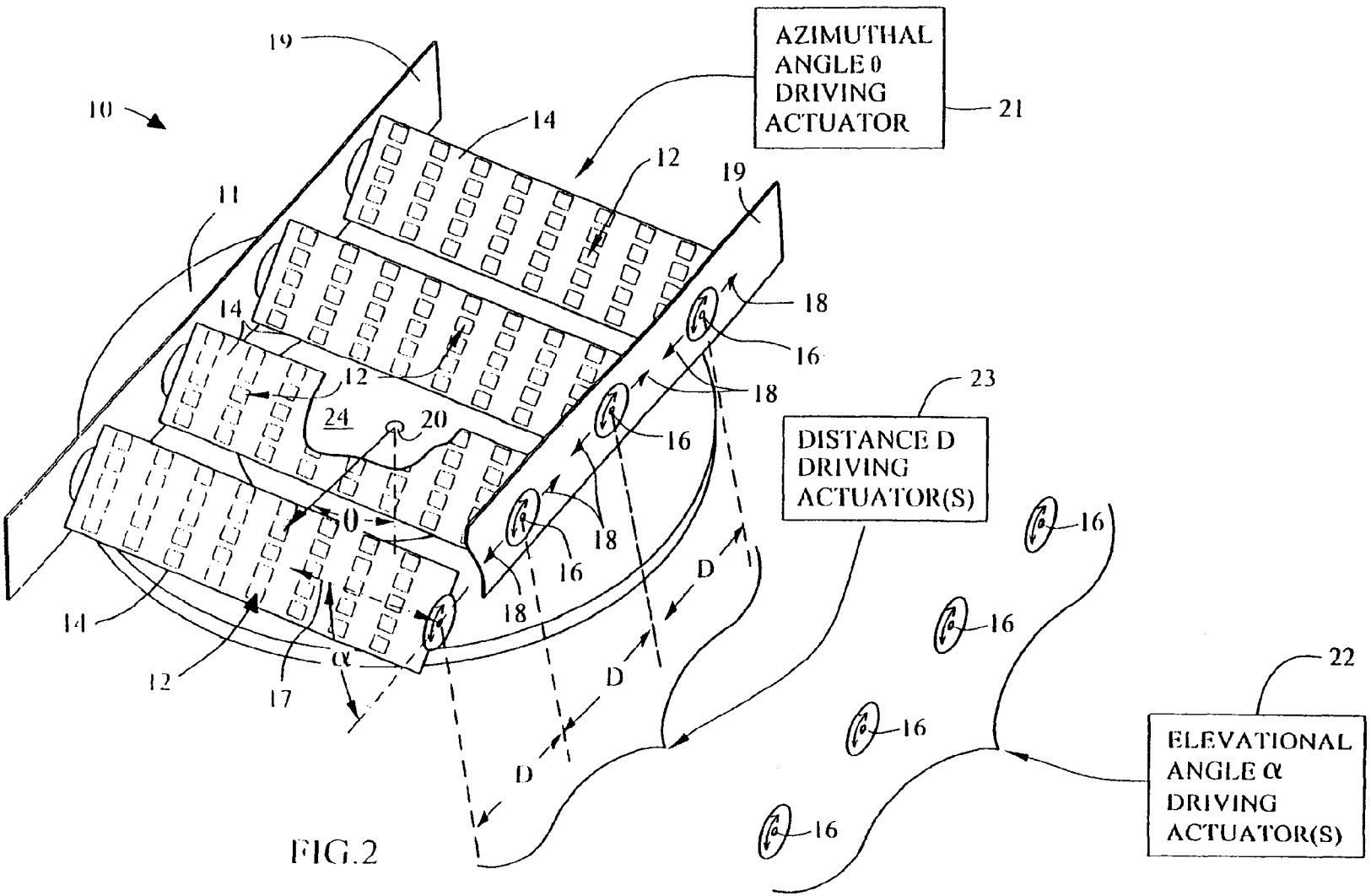
FIG. 2 is a three-dimensional, perspective view of an embodiment of an antenna array system according to some embodiments of the present invention.

Referring now to FIGS. 1 and 2, an antenna 10 according to some embodiments of the present invention is illustrated. Antenna 10 may include a plurality of antenna elements 12 disposed on active panel 14 preferably arranged in an array. Antenna elements 12 may comprise any type of antenna receiving and/or transmitting units useful for operation in the frequency range intended for use with antenna 10. Antenna elements 12 may be disposed on active panel 14 having any desired substantially-plane shape and preferably a rectangular plane. Antenna elements 12 may be disposed on active panel 14 in any desired pattern including for example, but not limited to, a 3×5 array, a 2×4 array, a 5×8 array and the like, or-any non-rectangular pattern including, for example, any circular, oval or pseudo-random pattern.

Antenna elements 12 may preferably be radiating elements having for example a diameter of one-half of the wavelength ($\lambda$) of the signal to which antenna 10 is designed for and may be disposed on active panel 14 in a rectangular pattern such as any one of the above mentioned patterns.

The array of antenna elements 12 is disposed on active panels 14 and interconnected by suitably phased combining/splitting circuits 8 such that the effective focus point direction 17 of each of the antenna elements 12 points in a direction that is substantially at an angle of incidence a with respect to a reference plane designated 11 in FIG. 1. As illustrated in FIGS. 1 and 2, antenna elements 12 are directed to coherently receive (or transmit) in a direction substantially along a line 17, normal to the plane of an active panel 14 and passing substantially through the center of an active panel 14. Each sub-array of elements 12 may thus receive radiation arriving at the angle of incidence $\alpha$ with respect to reference plane 11. In a transmitting embodiment, each of elements 12 may transmit radiation at an angle of incidence $\alpha$ with respect to reference plane 11. As noted above and as will be apparent to those in the art, coherent combining/splitting transmission line circuits 8 interconnect the individual antenna elements 12 within each panel 14 and then collectively (via each panel port 8*a*) to a common RF input/output port 9.

In the embodiment illustrated in FIGS. 1 and 2, antenna 10 is tuned to receive signals having a wavelength of approximately 24 mm or 2.4 cm, i.e., 12.5 GHz. The width of an active panel 14 is denoted as $d_L$. Thus if a two row array of 2.4 cm wavelength antenna elements is disposed on a panel, the profile height of the panels 14 above reference 11 even at low elevational angles would only need be on the order of 5 cm.

With respect to FIGS. 1 and 2, the horizontal distance between corresponding points in adjacent active panels 14 may be given by $D=d_L/\sin(\alpha)$ wherein:

$\alpha$=the angle between the normal line 17 to an active panel and the reference plane 11 that is usually parallel to a body of a mobile platform to which antenna 10 may be attached;

$d_L$=width of an active panel 14.

When the direction of antenna 10 tracks properly the direction of radiation, angle $\alpha$between the normal 17 to active panels 14 and reference plane 11 substantially equals angle a between the radiation source and the reference plane 11.

For n active panels 14 in antenna 10, the total length D' of antenna 10 may be calculated from $D'=(n-1)*D+d_L*\sin(\alpha)$.

The inter-panel distance D may be determined to be so that when looking at antenna 10 from an angle of incidence $\alpha$, an active panel 14 shall substantially not cover, partially or totally, any part of an adjacent active panel 14. Furthermore, viewed from an angle $\alpha$, all active panels 14 will seem to substantially border (i.e., be contiguous to or touch) each other. To allow that for a range of tilting angles $\alpha$, tilt axes 16 of active panels 14 may be slidably attached as schematically indicated at 18 to a support construction 19 with possible movement in a direction parallel to reference plane 11 (as shown by arrows 18) so that tilt axes 16 of all active panels 14 remain substantially parallel to each other and perpendicular to support construction 19, thus distance D may be controlled. Said control of distance D may be aimed to follow the adaptation of receive/transmit angle $\alpha$ so that non-overlap of outer lines of adjacent active panels 14, as defined above, is maintained for all values of $\alpha$ within an operable design range.

It has been determined that an antenna configured according to the principles set out herein greatly reduces the loss of gain of the antenna beam due to sub-array-plane to sub-array-plane partial coverage. Furthermore, because all the active panels 14 are fully open to radiation impinging on antenna 10 at the angle of incidence a, then the entire active panel apertures across the entire antenna 10 add-up (i.e., coherently combine for receive or split for transmit) to make the antenna's total effective aperture size high and, therefore, antenna 10 has a relatively high antenna gain, which enables antenna 10 to be used in low energy communication systems, such as for satellite communication purposes. Also, an antenna configured according to the principles set out herein eliminates (or greatly reduces) so-called grating lobes due to gaps or spacing that may otherwise be created between the projections of the active panels onto a plane perpendicular to the effective angle of incidence.

It is noted that the azimuth pointing angle $\theta$ of the antenna 10 can be changed by rotating it about a center axis 20 which is normal to reference plane 11 and crosses it substantially through its center point. In a similar manner the elevational pointing angle a of the antenna 10 can be changed by tilting active panels 14 synchronously, while distance D is adjusted so as to maintain effectively contiguous full aperture coverage over a suitable design range of elevation angles. Setting the azimuth and elevational angles $\theta$, $\alpha$of antenna 10 and distance D may be done manually or automatically, using any suitable driving actuator(s) 21, 22, 23, respectively, such as, but not limited to, pneumatic linear actuators, electrical linear actuators, motors with suitable transmissions, etc.

Antenna 10 may also be positioned on a rotatable carrying platform 24 that may allow to rotate it about an axis 20 that is perpendicular to reference plane 11 to any desired azimuth angle $\theta$.

Using any suitable controllable driving means (e.g., 21, 22, 23) the beam of the antenna 10 may be steered to point to any desired combination of azimuth and elevation angles (e.g., with a suitable design range), thus to receive or to transmit signals from or to a moving source/receiver, or to account for movement of the antenna with respect to a stationary or a moving source/receiver.

Figure 3:
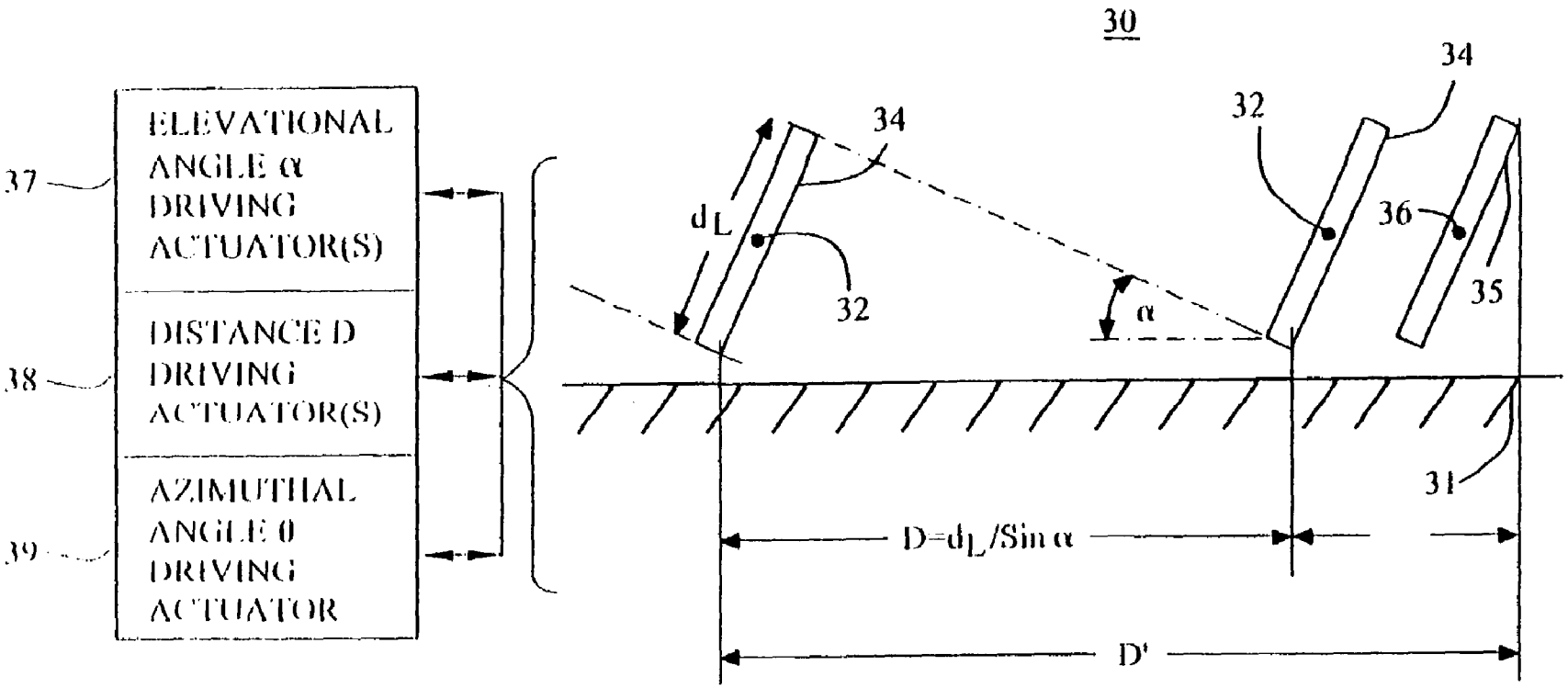
FIG. 3 is a diagrammatic view of an embodiment of an antenna array system according to some embodiments of the present invention.

Referring to FIG. 3, antenna 30 is shown as built and operated according to some embodiments of the present invention. Antenna 30 comprises a limited number of active panels 34 (of width $d_L$), two active panels in the example of FIG. 3. Active panels 34 may be tilted about their tilting axes 32 according to the principles of operation explained above. Antenna 30 comprises also one or more auxiliary active panels 35, which also may be tilted about an axis 36 to define an elevational angle a with respect to a reference surface 31. Auxiliary active panel 35 may be tilted according to the principle of operation of active panels 34 when the elevation angle a is within a predefined higher tilting range of elevation angle α. This arrangement may be useful, for example, in cases where the overall longitudinal dimension D' of antenna 30 is limited, due to constructional constraints for example, hence the distance between active panel 34 and an adjacent auxiliary active panel 35 can not always follow the rules dictated above for a certain (lower) range of titling angles α.

Preferably, driving actuators 37, 38, 39 may be used to provide the maximum beam steering range considered necessary for the particular use of antenna 30. The driving actuators may be of any suitable kind, such as but not limited to, pneumatic linear actuator, electrical linear actuator, a motor with a suitable transmission, etc. As is evident, the maximum beam steering necessary for any particular antenna will be dependent on the amount of expected change in the angle of incidence of the received signal (in the case of a receiving antenna) or in the position of the receiver (in the case of a transmitting antenna) and on the width of the antenna beam, which is a function of the size or aperture of the antenna. The larger the aperture, the narrower the beam.

Figure 4:
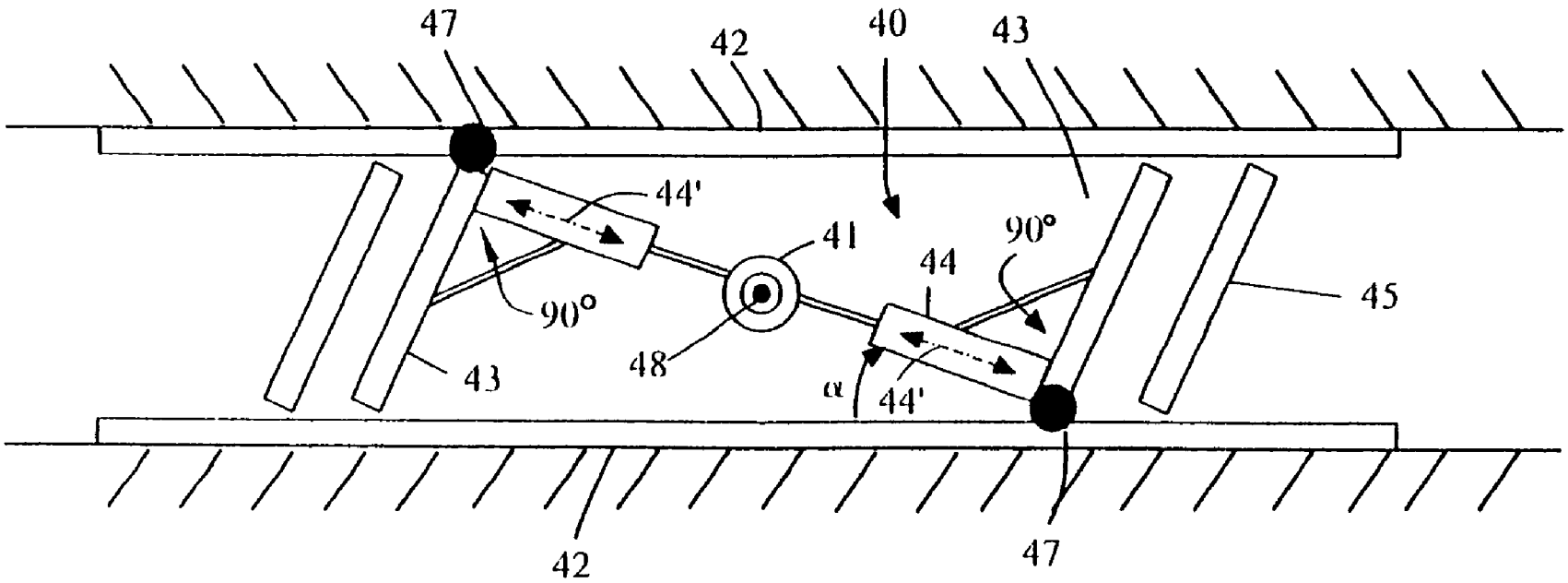
FIG. 4 is a diagrammatic illustration of the operation of an antenna array arrangement according to some embodiments of the present invention.

Referring now to FIG. 4, which is a diagrammatic illustration of the construction and operation of an antenna arrangement according to some embodiments of the present invention, a low profile antenna 40 is presented. An actuator 41, guiding rails 42, antenna active panels 43 auxiliary antenna active panel 45, an extendible rod 44 and slidable support means 47 are employed. The angle between extendible rod 44 and antenna active panels 43 is rigidly secured to be a predefined angle, approximately 90° in the present example of FIG. 4. The activation of actuator 41 may cause extendible rods 44 to extend or shorten along the mutual longitudinal axis 44' of extendible rods 44, while the two active panels 43 are maintained substantially parallel to each other and therefore angle a is changed. Similarly, actuator 41 may turn about its central axis 48, thus changing the relative angle between extendible rods 44 and guiding rails 42 so as to change angle a and maintain active panels 43 substantially parallel to each other.

One exemplary embodiment of our antenna includes a plurality of antenna elements disposed on one or more active panels, and a support frame wherein the active panels are rotatably connected to the support frame along parallel respective rotation axes. The active panels are also parallelly movable with respect to each other along lines which are included in the same plane with said rotation axes. The active panels are commonly directable to a focus point wherein, when the active panels point at a predetermined angle of incidence, then each adjacent pair of said active panels substantially border each other when viewed from that angle. That is, at each angle of incidence, the panels are moved so that a projection of active panels on a plane perpendicular to the angle of incidence reveals no gap between the projections of any two adjacent active panels. In this embodiment, where the active panels point at this preferred predetermined angle, then overall antenna gain will approximate that of a single antenna with an aperture similar to the sum of all the apertures of the active panels.

If desired, this embodiment may also deploy at least one auxiliary active panel that is also rotatable about its axis so as to be parallel to the active panels for a limited range of the angle of incidence.

The support frame for the active panels is preferably rotatable around an axis perpendicular to a plane including the rotational axes of the active panels. The rotation of the active panels is activated by an actuator. Parallel movements are also activated by an actuator. The angular direction of said directable active panels is also activated by an actuator. The rotation of the rotatable support frame is also activated by an actuator. The actuators may be any one of a linear pneumatic actuator, electrical linear actuator or electrical motor.

One exemplary embodiment of a method for receiving or transmitting electrical signals by an antenna includes providing plural antenna panels, each comprising antenna elements; rotatably supporting the antenna panels and directing the antenna panels to a common focus point toward a transmitter or receiver. The plurality of active antenna panels may be rotated around an axis perpendicular to their rotatable axes. The active antenna panels are directed and/or rotated by at least one actuator.

What is claimed is:

1. An antenna system comprising:

at least two antenna arrangements, each having at least one port, and all ports connected through transmission lines in a combining/splitting circuit, wherein said antenna arrangements form a spatial element array able to track a target in an elevation plane by mechanically rotating the antenna arrangements about transverse axes giving rise to generation of respective elevation angles and changing the respective distances between said axes in a predefined relationship at least with the respective elevation angles;

said combining/splitting circuit provides phasing and signal delay in order to maintain preconfigured radiating parameters.

2. The antenna system of claim 1, wherein projections of said antenna arrangements on a plane perpendicular to the elevation direction are touching or overlapping.

3. The antenna system of claim 1, wherein said antenna arrangements are planar element arrays.

4. The antenna system according to claim 3, wherein said planar element arrays are planar phased arrays.

5. The antenna system of claim 1, wherein said antenna arrangements are conformal element arrays.

6. The antenna system according to claim 5, wherein said conformal element arrays are conformal phased arrays.

7. The antenna system of claim 1, wherein said respective elevation angles are identical (e) for all antenna arrangements and said respective distances are identical (D) between each neighboring axes.

8. The antenna system of claim 7, wherein said relationship substantially complies with the following equation:

$$D=1/\sin(e)*W$$

where D represents the distance between said axes, e represents said elevation angle, and W represents a width of each antenna arrangement.

9. The antenna system according to claim 1, wherein said arrangements provide either or both of transmit and receive modes.

10. The antenna system according to claim 1, wherein each one of said antenna arrangements consists of more than one planar element array antenna module.

11. The antenna system according to claim 10, wherein said planar element array antenna modules are planar phase array antenna modules.

12. The antenna system according to claim 1, wherein the relationship between the respective distances and the respective elevation angles is non-linear chosen to maximize gain and minimize side lobes for a whole field of view, and performing selected overlapping of projections towards the target for lower elevation angles.

13. The antenna system of claim 1, wherein said target being a selected satellite, and wherein said antenna is configured to be fitted on mobile vehicle, for communicating with satellite signals during stationary and moving states of said vehicle.

14. The antenna system according to claim 13, wherein said vehicle being any of: train, bus, SUV, RV, boat, car or aircraft.

15. The system according to claim 13, wherein said antenna is configured to be fitted on a mobile vehicle, for receiving satellite signals during stationary and moving states of said vehicle.

16. An antenna system including:

at least two antenna arrangements mounted on a common rotary platform, using a carriage for each arrangement which provides mechanical bearing for an axis perpendicular to the elevation plane of the antenna arrangement, to thereby provide its elevation movement;

wherein the axes of rotation of all antenna arrangements are parallel each to other;

two rails joined with the carriages are mounted on the rotary platform at their bottom side, and driving means providing linear guided movement of the axes of rotation in direction perpendicular to the axes of rotation of the antenna arrangements.

17. An antenna assembly for satellite tracking system comprising:

at least two antenna arrangements forming a spatial element array capable of dynamic tracking a target in an elevation plane by mechanically dynamically rotating the antenna arrangements about transverse axes giving rise to generation of respective elevation angles, and dynamically changing the respective distances between said axes while maintaining a predefined relationship between said distances and respective elevation angles;

said antenna arrangement each having at least one port, and all ports connected to at least one combining/splitting circuit providing phasing and signal delay in order to maintain preconfigured radiating parameters.

18. The antenna assembly of claim 17, wherein projections of said antenna arrangements on a plane perpendicular to the elevation direction are substantially touching or overlapping.

19. The antenna assembly of claim 17, wherein projections of said antenna arrangements on a plane perpendicular to the elevation direction have at most small gaps while maintaining preconfigured side lobe parameters.

20. The antenna assembly of claim 17, wherein said antenna arrangements are planar element arrays.

21. The antenna assembly of claim 20, wherein said planar element arrays being planar phased arrays.

22. The antenna assembly of claim 17, wherein said antenna arrangements are conformal element arrays.

23. The antenna assembly of claim 22, wherein said conformal element arrays being conformal phased arrays.

24. The antenna assembly of claim 17, wherein, during said dynamic tracking, said respective elevation angles are substantially identical (e) for all antenna arrangements, and said respective distances are substantially identical (D) between each neighboring axes.

25. The antenna assembly of claim 17, wherein said relationship substantially complies with the following equation:

$$D=1/\sin(e)*W$$

where D represents the distance between said axes, e represents said elevation angle, and W represents a width of each antenna arrangement.

26. The antenna assembly of claim 17, wherein said arrangements provide either or both of transmit and receive modes.

27. The antenna assembly of claim 17, wherein each one of said antenna arrangements consists of more than one planar element array antenna module.

28. The antenna assembly of claim 27, wherein said planar element array antenna modules being planar phase array antenna modules.

29. The antenna assembly of claim 17, wherein the relationship between the respective distances and the respective elevation angles is non-linear chosen to maximize gain and minimize side lobes for a whole field of view, and performing selected overlapping of projections towards the target for lower elevation angles.

30. The antenna assembly of claim 17, wherein the relationship between the respective distances and the respective elevation angles is configured to vary dynamically to optimize gain and side lobes for a whole field of view.

31. The antenna assembly of claim 17, wherein the relationship between the respective distances and the respective elevation angles is fixed to optimize projections towards the target for certain elevation angles.

32. The antenna assembly of claim 17, wherein said target being a selected satellite, and wherein said antenna is configured to be fitted on mobile vehicle, for communicating with satellite signals during stationary and moving states of said vehicle.

33. The antenna assembly of claim 32, wherein said vehicle being any of train, bus, SUV, RV, boat, car, truck, aircraft or farm vehicle.

34. The antenna assembly of claim 33, wherein said assembly is configured to be fitted on mobile vehicle, for receiving satellite signal during stationary and moving states of said vehicle.

35. An antenna assembly for satellite tracking system including at least two antenna arrangements mounted on a common rotary platform, using a carriage for each arrangement which provides mechanical bearing for an axis perpendicular to the elevation plane of the antenna arrangement, to thereby provide its dynamic elevation movement;

wherein the axes of rotation of all antenna arrangements are parallel each to other; and two rails joined with the carriages are mounted on the rotary platform at their bottom side, driving means providing linear guided movement of the axes of rotation in direction perpendicular to the axes of rotation of the antenna arrangements in a predefined relationship at least with the respective elevation movement.

36. An antenna assembly for satellite tracking system comprising:

at least two antenna arrangements each accommodating a transverse axis;

a mechanism for rotating the arrangements in order to track a target in an azimuth plane, and rotating each arrangement about its transverse axis in order to dynamically track the target in an elevation plane, the system further includes at least one of the following:

a) a mechanism for dynamically changing distance between the transverse axes so as to maintain substantially no gaps between antenna apertures as viewed for any elevation angle within selectable elevation angle range;

b) a mechanism for dynamically changing distance between the transverse axes, so as to maintain substantially no gaps between antenna apertures for any location where a target is in the field of view of the antenna system; and c) a mechanism for dynamically changing distance between the transverse axes, while maintaining antenna gain and side lobes level within a predefined range for any elevation angle within a predefined range of elevation angles.

37. The antenna assembly of claim 36, wherein said mechanism for moving the transverse axes one with respect to the other, while maintaining antenna gain and side lobes level within a predefined range for any elevation angle within a predefined range of elevation angles is configured to move the transverse axes one with respect to the other, while maintaining antenna gain and side lobes level substantially the same for any elevation angle within a predefined range of elevation angles.

* * * * *